US005433634A

United States Patent [19]

Nakayama et al.

[11] Patent Number: 5,433,634

[45] Date of Patent: Jul. 18, 1995

[54] EXHAUST TREATMENT FOR OUTBOARD MOTOR

[75] Inventors: Manabu Nakayama; Atsushi Isogawa, both of Hamamatsu, Japan

[73] Assignee: Sanshin Kogyo Kabushiki Kaisha, Hamamatsu, Japan

[21] Appl. No.: 166,461

[22] Filed: Dec. 14, 1993

[30] Foreign Application Priority Data

Dec. 14, 1992 [JP] Japan ..... 4-353656

[51] Int. Cl.[6] ..... B63H 21/38

[52] U.S. Cl. ..... 440/1; 60/299; 440/89

[58] Field of Search ..... 440/1, 89, 88; 60/299, 60/302, 314

[56] References Cited

U.S. PATENT DOCUMENTS

| | | | |
|---|---|---|---|
| 3,431,882 | 3/1969 | Irgens | 440/89 X |
| 5,043,727 | 8/1991 | Ito | 440/2 X |
| 5,045,001 | 9/1991 | Borst | 440/1 |
| 5,073,133 | 12/1991 | Inoue | 440/1 |

FOREIGN PATENT DOCUMENTS 62-28288 6/1987 Japan .

*Primary Examiner*—Sherman Basinger

*Attorney, Agent, or Firm*—Knobbe, Martens, Olson & Bear

[57] ABSTRACT

An exhaust system for a marine propulsion outboard drive wherein the exhaust gases are normally discharged to the atmosphere at a point below the level of the body of water in which the watercraft is operating. A catalyst bed is provided in the exhaust system and the catalyst bed is protected from damage by pumping water from the exhaust conduit in response to certain conditions. These conditions may be either rapid deceleration of the engine or watercraft, stopping of the engine, or any of a combination of sensed factors. The water is pumped by a water pump which is positioned either in the outboard drive or in the hull of the associated watercraft. The pumping of water is initiated for only a predetermined time or until the sensed condition no longer is existent.

46 Claims, 4 Drawing Sheets

| | | |
|---|---|---|
| A1 | Engine Speed | Ne |
| A2 | Intake Manifold Pressure | Pi |
| A3 | Exhaust Pipe Pressure | Pe |
| A4 | Water Level Height | H |

| | |
|---|---|
| B1 | Ne=0 |
| B2 | Pi=0 |
| B3 | Pe=0 |
| B4 | H= As Specified |

| | | |
|---|---|---|
| C | Turn Pump On | Pump Water Out |

EXHAUST TREATMENT FOR OUTBOARD MOTOR

BACKGROUND OF THE INVENTION

This invention relates to an exhaust treatment for an outboard motor, and more particularly to an improved catalytic exhaust system for such outboard motors.

The desirability of effectively controlling the amount of harmful exhaust gas constituents in internal combustion engines are well known. These goals are particularly desirable in conjunction with outboard motors wherein the exhaust gases are discharged not directly to the atmosphere but through the body of water in which the associated watercraft is operating. As a result of this, not only is there a danger of air pollution from undesirable exhaust gas constituents but also a problem in conjunction with possible water pollution.

Although many steps are taken in the basic design of the engine to ensure good fuel efficiency and effective exhaust gas treatment, under some instances it is desirable to also employ catalysts in the exhaust system for treatment to reduce certain harmful exhaust gas constituents. As is well known, these catalysts operate at relatively high temperatures in order to be fully effective, and their efficiency depends upon their temperature.

As has been previously noted, it is the normal practice in marine propulsion units to discharge the exhaust gases to the atmosphere through the body of water in which the watercraft is operating. This is particularly desirable because most marine propulsion systems do not offer sufficient space for full engine exhaust silencing. By discharging the exhaust gases to the atmosphere through the body of water in which the watercraft is operating, further silencing can be obtained.

However, the use of such underwater exhaust gas discharges can present some problems, particularly where catalytic exhaust systems are employed. The water level within the exhaust system can change quite abruptly during engine operation. For example, when the watercraft is traveling at a high speed and is in a planing condition, the underwater discharge and exhaust system is relatively shallowly submerged. The exhaust gas pressure is high enough so as to ensure that water cannot enter backward through the exhaust system and come into contact with the catalyst.

If, however, the boat is abruptly decelerated, then the boat and its propulsion system becomes more deeply submerged in the body of water in which the watercraft is operating. In addition, at this time the exhaust pressure falls off, and water can easily flow back into the exhaust system through the underwater exhaust gas discharge. If this water comes into contact with the catalyst, the catalyst may become polluted and inoperative or, alternatively, have its efficiency deteriorated. In a worst case situation, the catalyst bed may actually become shattered or damaged due to the impacting of water on it at its elevated temperature and the fact that many catalyst beds are of ceramic-type material. These problems are particularly acute in operating in saltwater environments as the salt in the water may offer further fouling of the catalyst.

It is therefore a principal object of this invention to provide an improved exhaust treatment for an outboard motor.

It is a further object of this invention to provide an improved arrangement for protecting an outboard motor and its catalytic exhaust system from damages or inefficiency under all running conditions.

It is a further object of this invention to provide a catalytic exhaust system for a marine propulsion unit wherein it would be ensured that the water through which the exhaust gases are discharged cannot reach the catalytic bed.

Even in marine exhaust systems that do not include catalytic treatment in the exhaust gases, there is a desirability to ensure against water encroaching into the exhaust conduit above a predetermined point. As is well known, there are times when the exhaust pulses may produce actually a negative pressure at the discharge end of the exhaust pipe that conveys the exhaust gases to its underwater exhaust gas discharge. If water can reach this level under such conditions as extreme deceleration, then there is a risk that the water can actually enter into the engine through its exhaust port. This is obviously undesirable.

It is therefore a still further object of this invention to provide an improved exhaust system for a marine propulsion unit wherein it is ensured that water cannot enter the engine through its exhaust ports.

It is a further object of this invention to provide an improved system for protecting against undue rise in the water level in the exhaust system of an outboard drive.

SUMMARY OF THE INVENTION

This invention is adapted to be embodied in a marine outboard drive that is comprised of an internal combustion engine having at least one exhaust port. A drive shaft housing and lower unit is adapted to be supported on the transom of an associated watercraft and has a propulsion device that is driven by the engine for propelling the watercraft through a body of water. An underwater exhaust gas discharge is formed in the drive shaft housing and lower unit for discharging exhaust gases to the atmosphere through the body of water in which the watercraft is operating. Exhaust conduit means deliver exhaust gases from the exhaust port to the underwater exhaust gas discharge. Means are responsive to a sensed condition for removing water from above a predetermined position in the exhaust conduit means.

DETAILED DESCRIPTION OF THE PREFERRED EMBODIMENTS OF THE INVENTION

Figure 1:
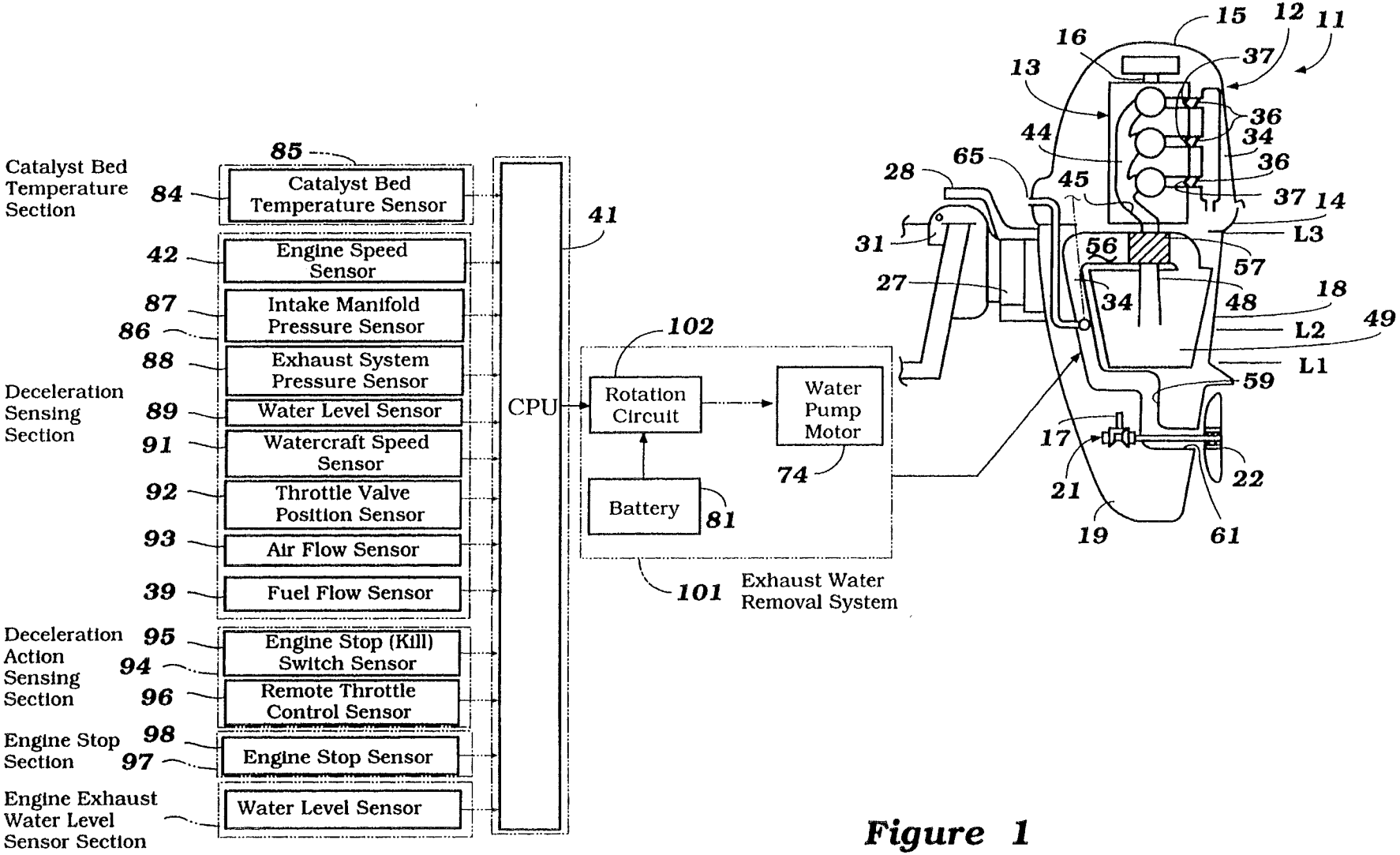
FIG. 1 is a partially schematic cross-sectional view of an outboard motor attached to the transom of an associated watercraft (shown only partially) and the various components of the system for protecting the catalytic exhaust system.
Figure 2:
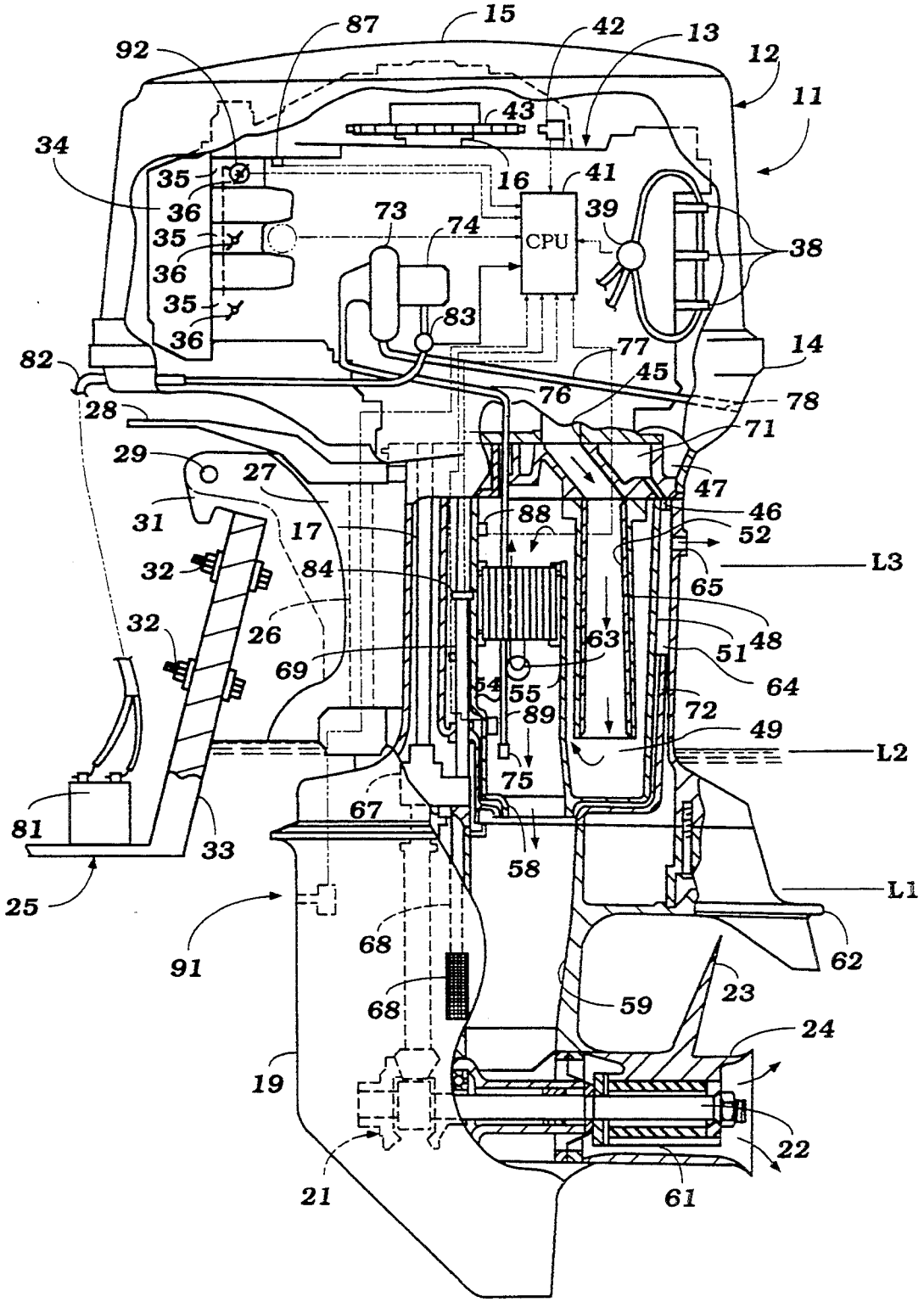
FIG. 2 is an enlarged cross-sectional view of the outboard motor portion shown in FIG. 1 and showing in more detail the actual construction.
Figure 3:
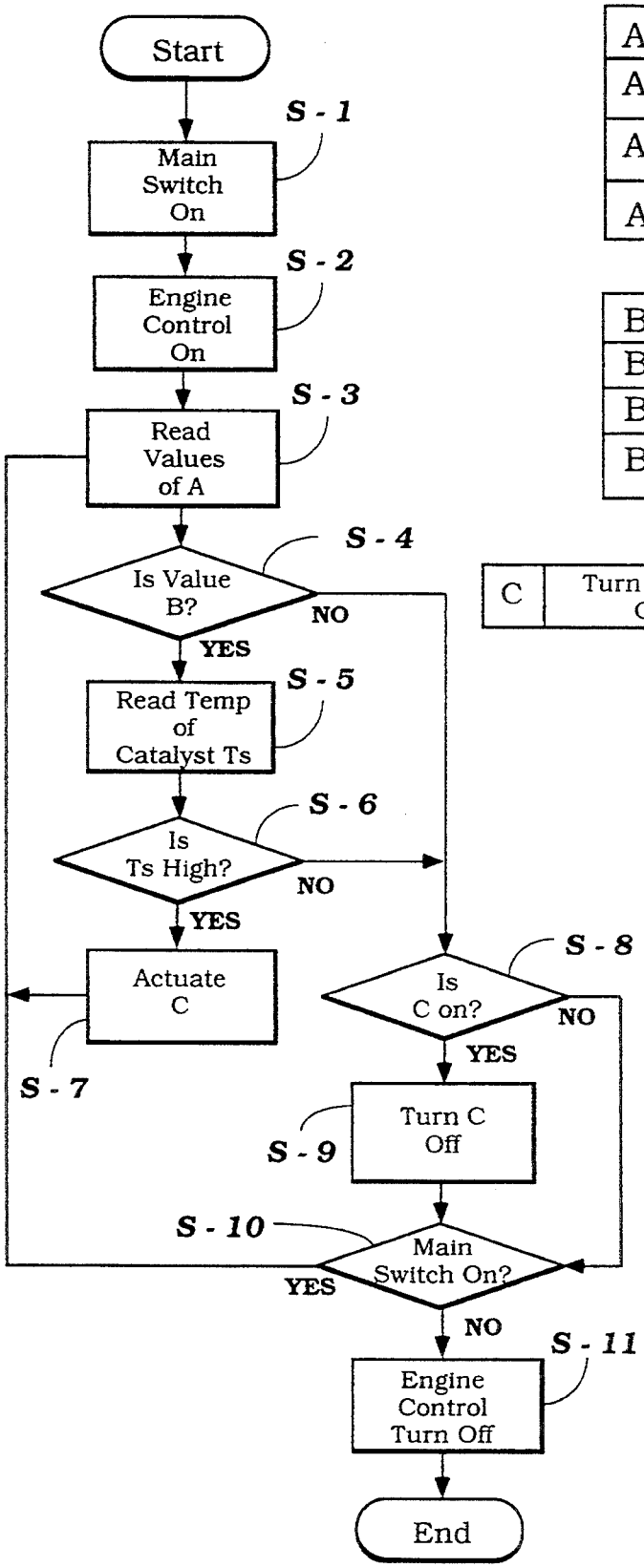
FIG. 3 is a block diagram showing a control routine in accordance with the invention.

Referring now in detail to the embodiment of FIGS. 1–3, and initially to FIGS. 1 and 2, an outboard motor constructed in accordance with an embodiment of the invention is identified generally by the reference numeral 11. The invention is described in conjunction with an outboard motor because it has particular utility in conjunction with watercraft and the exhaust systems therefor and has particular application with outboard motors. It should be readily apparent, however, that the invention may also be used in conjunction with inboard/outboard drives of the type wherein there is an exhaust system that discharges the exhaust gases from the powering internal combustion engine beneath the body of water in which the watercraft is operating.

The outboard motor 11 includes a power head assembly, indicated generally by the reference numeral 12, which is comprised of a powering internal combustion engine 13 and a surrounding protective cowling comprised of a lower tray portion 14 and an upper removable main cowling portion 15. Although the invention is capable for use with a wide variety of types of internal combustion engines, in the illustrated embodiment, the engine 13 is of the three-cylinder in-line type operating on a two-stroke crankcase compression principle. It will be readily apparent to those skilled in the art, however, that the invention may be practiced with a wide variety of types of engines. The invention does have particular utility, however, in conjunction with two cycle crankcase compression engines because these engines normally are lubricated by lubricant that is not recirculated but is passed through the engine and then burned in the combustion chambers and exhausted through the exhaust system. This presents certain problems in conjunction with exhaust emission control.

Some details of the construction of the engine 13 will be described later because they are involved in the control strategy.

The engine 13, as is typical with outboard motor practice, is supported so that its output shaft, a crankshaft 16, rotates about a generally vertically extending axis. This crankshaft is coupled to a drive shaft 17, which depends into a drive shaft housing 18 and is rotatably journalled therein in any well-known manner. A lower unit 19 depends from the drive shaft housing 18 and contains a conventional forward, neutral, reverse transmission, indicated generally by the reference numeral 21 for driving a propeller shaft 22 in selected forward and reverse directions. A propeller 23 has a hub portion 24 that is coupled to the propeller shaft 22 for propelling the associated watercraft, shown partially and indicated generally by the reference numeral 25 in a well-known manner.

A steering shaft 26 is affixed to the drive shaft housing 18 in a known manner and is supported for steering movement about a generally vertically extending steering axis in a swivel bracket 27. A tiller 28 is affixed to the upper end of the steering shaft 26 and is coupled to any form of remote steering mechanism or may be steered directly for controlling the direction of travel of the associated watercraft 25.

The swivel bracket 27 is, in turn, pivotally connected by means of a pivot pin 29 to a clamping bracket 31. This pivotal connection permits tilt and trim movement of the outboard motor 11, as is well known in this art. The clamping bracket 31 is provided with means, such as threaded fasteners 32, for a detachable connection to a transom 33 of the associated watercraft 25.

Referring now again to the power head 12, although the invention deals primarily with the exhaust system, and the internal details of the engine 13 are not particularly essential to the understanding of the invention, certain components will be described because they incorporate features that present certain control parameters to be measured.

It has been noted that the engine 13 is of the three-cylinder in-line type that operates on a two-stroke crankcase compression principle. In the illustrated embodiments, the engine 13 is mounted in the power head 12 so that its crankcase faces forwardly and the cylinder head faces rearwardly. As is conventional with two-cycle engines, an intake air charge is drawn into the crankcase chambers of the engine 13 through an induction system. This induction system includes an air intake device 34, which is contained with the protective cowling of the power head 12, and specifically within its upper housing portion 15. An air inlet (not shown) is provided in this protective cowling so that atmospheric air may be drawn into the air inlet device 34 for operation of the engine 13. The air inlet device 34 is designed so as to incorporate a silencing system for silencing the intake air charge, as is well known in this art.

The air drawn through the air inlet device 34 is transferred to a plurality of throttle bodies 35 in which throttle valves 36 are positioned so as to control the speed of the engine 13. The throttle valves 36 are all linked together by a mechanism so as to be simultaneously operable and operated through any remotely positioned throttle control in a well-known manner. The air charge is then delivered to the crankcase chambers of the engine through a suitable induction system, which includes read-type check valves 37 shown schematically in FIG. 1, which permit the air flow to occur into the crankcase chambers but prevent reverse flow when the charge is being compressed.

Although any form of charge-forming system may be employed in conjunction with the engine 13, in the illustrated embodiment the engine is provided with a fuel injection system that includes fuel injectors 38, which receive fuel from a remotely positioned fuel tank, through a supply conduit in which a flow rate sensor 39 is provided. The flow rate sensor 39 outputs its signal to a CPU, indicated generally by the reference numeral 41, which controls, among other things, the amount of fuel supplied to the engine by the injectors 38.

The engine 13 is also provided with a spark ignition system, including spark plugs (not shown) that is fired by the CPU 41 at the appropriate timing. This ignition system includes a speed sensor 42 of the pulser type which cooperates with a toothed wheel 43 affixed for rotation with the crankshaft 16 so as to provide pulses indicative of the rotational speed of the engine output shaft 16.

Of course, the fuel injection control and spark ignition control may include other sensors, some of which will be described. Some of these sensors also are employed in conjunction with the protective system for the exhaust system, which exhaust system will now be described by continued reference to FIGS. 1 and 2.

As shown schematically in FIG. 1, the engine 13 has exhaust ports that communicate with an exhaust manifold 44 that is formed integrally within the cylinder block of the engine and which has a downwardly facing discharge port 45. This discharge port communicates with a corresponding exhaust passage 46 formed in a spacer plate 47 upon which the engine 13 is mounted. The spacer plate 47 is supported on the upper side of the drive shaft housing 18 in a well-known manner. An exhaust pipe 48 is affixed to the underside of the spacer plate 47 and collects the exhaust gasses and discharges them into a first expansion chamber volume 49 formed within the drive shaft housing 18 by an inner shell 51. If desired, the internal surface of the exhaust pipe 48 may be coated with a catalytic material 52 so as to provide some treatment of the exhaust gasses before they are discharged into the first expansion chamber 49.

A vertically extending wall 53 formed within the inner shell 51 separates the first expansion chamber 49 from a second expansion chamber 54. Exhaust gasses that have flown through the first expansion chamber 49 must pass to the second expansion chamber 54 through an area 56 formed above the wall 53 so as to form a traplike construction which will assist in ensuring that water cannot flow back through the exhaust system to the exhaust ports of the engine under extreme situations and when the exhaust protection system, to be described, may malfunction.

At the upper end of the second expansion chamber 54, there is provided a catalyst bed 57 through which the exhaust gasses must pass before they can exit the second expansion chamber 54 through a downwardly facing discharge opening 58. Hence, the exhaust gasses that flow through the exhaust system as thus far described will be silenced by successive contractions through the exhaust pipe 48 and expansion in the expansion chamber 49, subsequent restriction or contraction in the trap section 56 and further expansion in the expansion chamber section 54. In addition, the catalyst beds 52 and 57 will treat such exhaust gas constituents as may be desired, depending upon the design. The specific catalytic materials chosen may be of any known type employed in this art.

An exhaust discharge passage 59 is formed in the lower unit 19 and receives exhaust gasses from the expansion chamber outlet 58. These exhaust gasses are then discharged to the atmosphere through the body of water in which the watercraft is operating through an underwater exhaust gas discharge. In the illustrated embodiment, this underwater exhaust gas discharge is indicated generally by the reference numeral 61, and this is of the through-the-hub type, which is discharged through the hub 24 of the propeller 23.

In FIGS. 1 and 2, there are depicted three water levels—L1, L2 and L3. The water level L2 is the water level that exists when the watercraft 25 is being propelled at a relatively high speed and is in a planing condition. This water level is just slightly above anti cavitation plate 21 of the lower unit 19. Under this running condition, substantially all of the exhaust gasses will be discharged to the atmosphere through the path as thus far described, including through the through-the-hub underwater exhaust gas discharge 61.

When the watercraft 25 is operating at a lower than planing speed or is stationary, the water level L2 will be higher. It should be noted that the lower end of the exhaust pipe 48 is disposed slightly above this lower water level. Under this condition, the exhaust gas pressure will be relatively low and not sufficient to exit through the underwater exhaust gas discharge 61. There is thus provided an above-the-water low speed exhaust gas discharge which is formed by a pair of openings 63 formed in the expansion chamber forming member 51 and which permit the exhaust gasses to flow out of the expansion chamber section 52 into a cavity 64 formed between the outer periphery of the inner shell 51 and the inner periphery of the drive shaft housing 18. An above-the-water exhaust gas discharge 65 is formed at the rear of the drive shaft housing 18 so that the exhaust gasses may be discharge through this opening when the water level is at the level L2. It should be noted that the exhaust gasses that are discharged through the opening 65 will have passed through the entire silencing section of the exhaust system, including the expansion chambers 49 and 54, and past both of the catalytic beds 52 and 57 so that even though the exhaust gasses are discharged directly to the atmosphere, they will be silenced and treated. The opening 65 is relatively restricted, however, so that when travelling at high speeds, there will be substantially no exhaust gasses transmitted directly to the atmosphere. It should be noted that this above-the-water exhaust gas discharge 65 is shown out of position in FIG. 1 for the sake of illustration purposes only.

The engine 13 is water cooled and has a cooling jacket and internal flow path which may be of any desired type. Water for cooling the engine is drawn through a water inlet opening 66 formed in the lower unit 19 by a water pump 67 driven from the drive shaft 17 at the interface between the drive shaft housing 18 and the lower unit 19. A conduit 68 extends from the water inlet opening 66 to the water pump 67. This water is then delivered to the engine cooling jacket through a supply conduit 69 which extends upwardly through the drive shaft housing 18 and communicates with the engine cooling jacket in any suitable manner. This coolant is then discharged downwardly through a cooling jacket 71 formed in the spacer plate 47 around its exhaust passage 46. The coolant is then further delivered to a water jacket formed around the expansion chamber forming inner shell 51 by an inner wall member 72 so as to cool the exhaust system. This water then spills over a weir and is discharged back into the body of water in which the watercraft is operating through any known type of discharge.

As has been noted, the highest water level experienced during normal running operations is the idle or stationary water level L2. The catalyst bed 57 is positioned above this water level and hence is protected under normal circumstances. However, there is a running condition when the water level could reach a higher level, and this is when the outboard motor 11 and associated watercraft 25 are travelling at a high speed and then suddenly decelerated. Under this condition, the water level may actually reach the level L3, and since the exhaust is generally open beneath the water, then water could reach the catalyst bed 57 and cause damage. This damage could be as severe as shattering of the bed due to its high. temperature and ceramic nature, or merely fowling it with the water. If the watercraft 25 is operating in a marine environment, then the salt water could leave deposits on the bed 57 that would cause it to lose efficiency. In accordance with an important feature of the invention, arrangements are provided in the embodiments which ensure that the water level cannot reach a level where the bed 57 could be damaged. Alternatively, the protective system may permit the water level to reach higher points, but only after the temperature of the bed 57 is low enough that damage would not occur.

In this particular embodiment, the protection is achieved by pumping water out of the exhaust conduit so as to prohibit the water level from rising, or if the water level has risen, to remove the water. This system includes a centrifugal pump 73 that is mounted on the side of the engine 13 within the power head 12 and which is driven by an electric motor 74. The water pump 73 draws water from within the expansion chamber section 54 at a point below the catalyst bed 57 through an inlet 75 and conduit 76. This water is then discharged overboard through a conduit 77 which terminates in a discharge opening 78 formed in the lower tray 14 of the protective cowling.

The electric motor 74 is provided with electrical power from a storage battery 81 which may be conveniently positioned in the hull of the watercraft 25 through conductors 82. An electrically operated control switch 83, actuated by the CPU 41, controls when the electric motor 74 and water pump 73 are driven. This control strategy will now be described after the various sensors employed in conjunction with the control are described.

The engine speed sensor 42 and fuel flow sensor 39 have already been described. Like those sensors, the sensors employed in conjunction with the exhaust protection system may also be employed to provide other signals for control of the running of the engine 13 by the CPU 41. In addition to those sensors which will be described, it will be obvious to those skilled in the art that still other forms of sensors may be employed for achieving the desired purpose.

The relationship of these sensors in their actual physical location appears in FIG. 2, while FIG. 1 shows the sensors schematically and their relationship with the CPU 41. Referring to these two figures, the sensor system includes a catalyst bed temperature sensor 84 which comprises a catalyst temperature sensor system section indicated by the phantom box 85 in FIG. 1. As may be seen in FIG. 2, this temperature sensor 84 is mounted in the inner shell 51 in proximity to the catalyst bed 57 and outputs its signal to the CPU 41.

Since the high water level condition exists primarily due to rapid decelerations, certain sensors also form a part of a decelerator sensing section, indicated generally by the reference numeral 86, and which includes, in addition to the engine speed sensor 42 and the fuel flow sensor 39, an intake manifold pressure sensor 87 which, as shown in FIG. 2, is mounted in the intake manifold of the engine downstream of one of the throttle bodies 35. As is well known, during rapid decelerations, the intake manifold pressure will be significantly reduced.

There is also provided an exhaust system pressure sensor 88 which is positioned at an appropriate location in the exhaust system and particularly in the area in the expansion chamber section 54 upstream of the catalyst bed 57 in the area where the high pressure air is delivered from the conduit 79. An decrease in the pressure in the exhaust system during times when the engine is running will be indicative that the engine is running at a slow speed or has stopped.

There is further provided a water level sensor 89 which is positioned in the expansion chamber 54 but below the catalyst bed 57 and slightly above the inlet 75 of the water pump 73. When the water level reaches the sensor 89, it will give a signal that will indicate that the water level is rising above the level L2 and to a point where the catalyst bed 57 might well be damaged or fouled.

There is also provided a watercraft speed sensor 91 which basically is a pitot tube type sensor that is positioned at the leading edge of the lower unit 91 and which will sense dynamic pressure and, accordingly, watercraft speed. If the watercraft speed has been high and then falls rapidly, the watercraft speed sensor 91 can indicate a rapid deceleration condition.

Associated with one of the throttle valves 36 is a throttle valve position sensor 92, and this provides an output signal indicative of throttle valve position. If the throttle valve 36 is held in a fully or largely opened position and then is closed rapidly, this will be an indication of rapid deceleration and a condition when the watercraft is being decelerated rapidly and the high water condition might exist.

The final deceleration sensor comprises an induction airflow sensor 93 which may be of the pressure-sensitive type positioned in the crankcase chambers of the engine. As is well known, sensing the crankcase pressure at certain crank angles is a good way of indicating air flow to the engine. If this air flow rate decreases suddenly, this is another good indication of rapid deceleration.

In addition to these sensors which sense actual engine or boat conditions, there is further provided a deceleration action sensing section, indicated generally by the reference numeral 94, which include sensors that sense when the operator is taking an action which is likely to produce sudden decelerations. This may include an engine kill or stop switch sensor 95 which is positioned remotely in the watercraft hull 25 and which is initiated by the operator so as to shut off the engine 13 by killing its ignition circuit. If this action is taken when the watercraft 25 is operating at a high speed, then it can also be assumed that there will be a sudden deceleration condition.

A further control is a sensor 96 which senses the position of the remote operator throttle control. If the operator moves the remote throttle control from a high speed condition to a low speed condition in a short time period, then it can be assumed that there is a deceleration condition present or imminent and protective action can be initiated promptly.

There is provided a further control section 97 which determines when the engine is actually stopped and this includes an engine stop sensor 98 indicates when the engine has been stopped. This may be done by measuring lack of rotation of the crankshaft 16, disabling of the ignition circuit, etc.

There is provided a further sensor section which is the exhaust passage internal water level sensor system indicated by the reference numeral 99 and this may include a float type device for providing a signal indicative of the actual water level in the exhaust system or in the drive shaft housing 18, which will in essence be the same.

All of these signals from the sensors described are transmitted to the CPU 41 so as to provide an indication of when protective action is required and how that protective action is initiated. This will be described later by reference to a control routine shown in FIG. 3. However, these are transmitted to an engine exhaust water removal system, indicated generally by the reference numeral 101 in FIG. 5 and which includes an actuating circuit 102 for operating the water pump 73. This actuating circuit 102 is powered by the battery 81 and controls the water pump motor 74.

A control routine for protecting the catalyst is depicted in FIG. 3 and will now be described in detail by reference to that figure. This control routine may be employed with any system for pumping water from the exhaust system to prevent it from reaching the catalyst bed 57 and in the specific embodiment illustrated, this is accomplished by turning on the pump motor 74 to drive the water pump 73 to pump any water which may be rising in the exhaust system back into the body of water in which the watercraft is operating through the discharge conduit 77 and outlet 57. In addition, FIG. 3 illustrates the measuring of only certain parameters and as has been previously discussed and as will be repeated, various other parameters can be sensed so as to determine when it is desirable to initiate protective action.

The program starts and moves to the first step S1 wherein the main switch for the control of the outboard motor 11 is initiated by the operator. The engine control routine then is automatically switched on at the step $2 and certain values are read at the step S3. These values are indicated as A.

In this embodiment, four values of A are read. These are engine speed A1 (Ne), intake manifold pressure A2 (Pi), exhaust pipe pressure A3 (Pe) and water level height A4 (H). From the values of engine speed, intake manifold pressure and exhaust pipe pressure, it may be determined that not only whether the engine is running, but also if it has been decelerated rapidly. In the case that the engine 13 has been stopped or decelerated rapidly, there is a condition when the water level may rise from the level L1 to the level L2 or even to the higher level L3 and pumping action may be desired. Stopping of the engine can be determined if either engine speed has gone to zero or if intake manifold pressure or exhaust pipe pressure becomes atmospheric pressure. Rapid deceleration can be determined if engine speed decreases by more than a predetermined amount in a predetermined time period or if intake manifold pressure or exhaust pipe pressure change by more than a predetermined amount in a predetermined time period. As has been previously noted, a rapid increase in intake manifold vacuum or decrease in intake manifold pressure will indicate an extreme deceleration condition and a-lrapid decrease in exhaust pipe pressure will also indicate a rapid deceleration.

After the values of A have been read, the program then moves to the step S4 to compare the values with the predetermined values at B which are indicative of the deceleration or stop condition. In the embodiment illustrated in FIG. 3, the determination is made as to whether the engine has stopped and thus, B1, B2 or B3 values of Ne, Pi or Pe equals zero, it will be determined that the engine has stopped. Insofar as determining the other condition of protection of the water level height H, if the water level height H is read at B4 as greater than a specified value, then it will be determined that pumping action may be required.

In the control routine described in FIG. 3, pumping action is not automatically initiated in the event the B value is read by the system. In accordance with this control routine, it is determined that pumping action is not required unless the catalyst temperature is greater than a predetermined temperature. Catalyst temperature is indicated as $T_s$ and if this temperature is greater than a predetermined value and the condition B is met, then pumping action will be initiated.

Therefore, at the step S5, the temperature of the catalyst is read and at the step S6 it is determined if the catalyst temperature is high enough as to require pumping action. If at the step S6 it is determined that the temperature is too high, the program then moves to the step S7 so as to switch on and begin the pumping action. In this embodiment, this condition is initiated by the CPU 41 switching on the switch 83 so as to activate the electric motor 74 and water pump 73 so as to begin pumping water out of the exhaust system in the manner aforenoted.

If at the step S4 it is determined that none of the read values of A are the values of B which require pumping action or if it is determined at the step S6 that the catalyst temperature is not too high, then the program moves to the step S8 so as to determine if a previously initiated pumping action is still being initiated. The pumping action may have been initiated because of a previous condition when the value of B had been met and the temperature of the catalyst bed was too high. However, assuming that now the value of B is not that which requires pumping action and/or the temperature of the catalyst bed was not too high and it is then determined at the step S8 that the pumping action had been initiated, the program then moves to the step S9 so as to deactivate the pumping action since it is no longer required. The program then moves to the step S10 to determine if the main switch is still on.

If at the step S10 it is determined that the main switch is still on, the program then moves back to the step S3 so as to continue to monitor the conditions to determine if pumping action is subsequently required. If, however, at the step S10 it is determined that the main switch has been turned off, then the program moves to the step Sll so as to turn off the engine control and then the program ends.

If at the step S8 it has been determined that the pumping action is no longer being init±ated, the program then jumps to the step S10 to determine the condition of the main switch. If the main switch is still on at the step S10, the program repeats back to the step S3 to continue to monitor conditions to determine if pumping action is subsequently required. If, at the step S10 it is determined that the main switch has been turned off, then the engine control is again turned off at the step Sll and the program ends.

As has been noted, this control routine is only one of many which can be employed to practice the invention. In this control routine, the pumping action is begun when one of the sensed conditions, in this case, engine stop is determined although as has been noted, the sense condition can also be a rapid deceleration. However, even the existence of this condition will not initiate protective action unless the catalyst temperature is high. 0f course, it may be possible to initiate pumping action even if the catalyst temperature is not desired to be determined or, alternatively, the pumping action can be initiated immediately if the catalyst temperature is determined to be too high. Also, the pumping action is stopped when both conditions no longer exist. It may be possible to stop the protective action only when the catalyst temperature falls below a predetermined temperature or when the water level is below the predetermined water level or, alternatively, there may be a time delay where it is necessary for the two conditions or one of the conditions not to exist for more than a predetermined time before the pumping action is discontinued. In addition, it is also possible to provide an arrangement wherein the pumping action is only initiated for a predetermined time period and then the program again repeats to determine if new or continued pumping action is required because the condition still call for it. These are only some of many types of control routines that can be employed and it will be obvious to those skilled in the art how such other control routines may be practiced.

Figure 4:
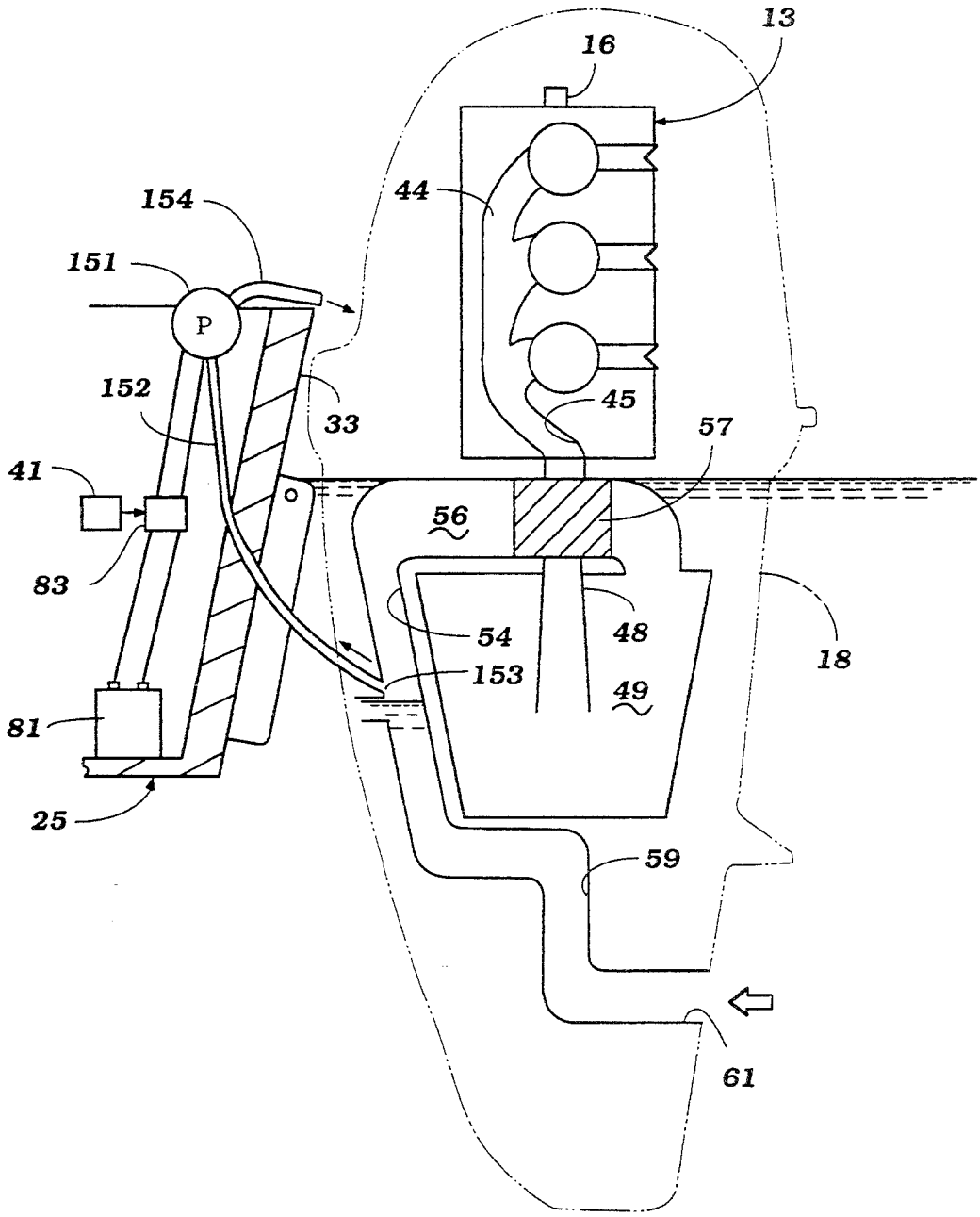
FIG. 4 is a partially schematic view, in part similar to FIG. 1, and shows another embodiment of the invention.

In the embodiment as thus far described, the water pump 73 and its electric drive motor 74 was positioned within the powerhead 12. It is to be understood that other types of pumping arrangements may be employed and FIG. 4 shows such an embodiment. This embodiment is generally the same as the embodiment of FIGS. 1 through 3 and for that reason, only a view partially corresponding to FIG. 1 is believed to be necessary to enable those skilled in the art to practice the invention. Also, since the only difference between these two embodiments is the location of the water pump, components which have been previously described and which are the same in this embodiment have been identified by the same reference numerals and will be described again only in so far as is necessary to understand the construction and operation of this embodiment.

In this embodiment, a water pump, indicated generally by the reference numeral 151 is positioned within the hull of the watercraft 25 in proximity to the transom 33. A pick-up conduit 152 extends over the transom 33 and is connected to the drive shaft housing 18 in any known manner and extends into the expansion chamber 54 at a point below the water level sensor 89 and the catalyst bed 57. A pick-up point 153 is positioned at this point which is slightly below the water level L2.

Like the previously described embodiment, the pump 151 is actuated by the CPU 41 through turning on of the switch 83, which in this embodiment can be located also in the hull of the watercraft 25. Again, any form of control routine may be employed.

The water pump 151 has a discharge conduit 154 that extends over the transom 33 in any convenient location and will pump the water removed from the exhaust conduit back into the body of water in which the watercraft is operating.

It should be readily apparent in the foregoing description that the described embodiments of the invention are extremely effective in protecting the catalyst bed from water damage or water fowling under conditions such as extreme deceleration or engine shut off when travelling forwardly. Of course, the described embodiments of the invention are only examples of ways in which the catalyst bed can be protected and various changes in modifications may be made without departing from the spirit and scope of the invention, as defined by the appended claims.

We claim:

1. A marine outboard drive comprising an internal combustion engine having at least one exhaust port, a drive shaft housing and lower unit adapted to be supported upon the transom of an associated watercraft and having a propulsion device driven by said engine for propelling said watercraft through a body of water, an underwater exhaust gas discharge formed in said drive shaft housing and lower unit for discharging exhaust gases to the atmosphere through the body of water in which said watercraft is operating, exhaust conduit means through which exhaust gases flow from said exhaust port for delivering exhaust gases from said exhaust port to said underwater exhaust gas discharge, water pump means having an inlet in the portion of said exhaust conduit means through which the exhaust qases pass for removing water from direct contact with the exhaust gases and an outlet for conveying pumped water back to the body of water in which the watercraft is operating, and means responsive to a condition for operating said water pump means for pumping water from said exhaust conduit means.

2. A marine outboard drive comprising an internal combustion engine as set forth in claim 1, further including means for sensing the condition.

3. A marine outboard drive comprising an internal combustion engine as set forth in claim 2, wherein the sensed condition comprises deceleration.

4. A marine outboard drive comprising an internal combustion engine as set forth in claim 3, wherein the sensed deceleration comprises watercraft deceleration.

5. A marine outboard drive comprising an internal combustion engine as set forth in claim 4, wherein the watercraft deceleration is determined by a watercraft speed sensor.

6. A marine outboard drive comprising an internal combustion engine as set forth in claim 3, wherein the deceleration comprises deceleration of the engine.

7. A marine outboard drive comprising an internal combustion engine as set forth in claim 6, further including a throttle valve for controlling the speed of the engine and wherein the sensed deceleration is determined by rapid closure of the throttle valve.

8. A marine outboard drive comprising an internal combustion engine as set forth in claim 6, wherein the sensed deceleration of the engine is determined by an air flow sensor.

9. A marine outboard drive comprising an internal combustion engine as set forth in claim 6, wherein the sensed engine deceleration is sensed by sensing intake manifold vacuum.

10. A marine outboard drive comprising an internal combustion engine as set forth in claim 6, wherein the sensed deceleration is determined by measuring the engine speed and determining when engine speed rapidly is decreased.

11. A marine outboard drive comprising an internal combuseion engine as set forth in claim 2, wherein the sensed condition is the stopping of the engine.

12. A marine outboard drive comprising an internal combustion engine having at least one exhaust port, a drive shaft housing and lower unit adapted to be supported upon the transom of an associated watercraft and having a propulsion device driven by said enqine for propelling said watercraft through a body of water, an underwater exhaust gas discharqe formed in said drive shaft housinq and lower unit for discharqing exhaust gases to the atmosphere through the body of water in which said watercraft is operating, exhaust conduit means through which exhaust gasses flow from said exhaust port for delivering exhaust gases from said exhaust port to said underwater exhaust gas discharge, water pump means having an inlet in said exhaust conduit means and an outlet for conveying pumped water back to the body of water in which the watercraft is operating, means responsive to a condition for operating said water pump means for pumping water from said exhaust conduit means, and means for sensing said condition, said sensed condition comprises a water level in said exhaust conduit means.

13. A marine outboard drive comprising an internal combustion engine as set forth in claim 12, wherein the sensing means comprises a water level sensor positioned in the exhaust conduit means.

14. A marine outboard drive comprising an internal combustion engine having at least one exhaust port, a drive shaft housing and lower unit adapted to be supported upon the transom of an associated watercraft and having a propulsion device driven by said engine for propelling said watercraft through a body of water, an underwater exhaust qas discharge formed in said drive shaft housing and lower unit for discharging exhaust gases to the atmosphere through the body of water in which said watercraft is operating, exhaust conduit means through which exhaust gasses flow from said exhaust port for delivering exhaust gases from said exhaust port to said underwater exhaust gas discharge, water pump means having an inlet in said exhaust conduit means and an outlet for conveying pumped water back to the body of water in which the watercraft is operating, means for sensing a plurality of conditions, and means for operating said water pump means for pumping water from said exhaust conduit means in response to the sensing of any of said conditions.

15. A marine outboard drive comprising an internal combustion engine as set forth in claim 14, wherein one of the conditions comprises water level in the exhaust conduit means.

16. A marine outboard drive comprising an internal combustion engine as set forth in claim 14, wherein one of the conditions sensed is engine speed deceleration.

17. A marine outboard drive comprising an internal combustion engine as set forth in claim 14, wherein one of the sensed conditions comprises deceleration of the associated watercraft.

18. A marine outboard drive comprising an internal combustion engine as set forth in claim 14, wherein one of the sensed conditions comprises stopping of the engine.

19. A marine outboard drive comprising an internal combustion engine having at least one exhaust port, a drive shaft housing and lower unit adapted to be supported upon the transom of an associated watercraft and having a propulsion device driven by said engine for propelling said watercraft through a body of water, an underwater exhaust gas discharge formed in said drive shaft housing and lower unit for discharging exhaust gases to the atmosphere through the body of water in which said watercraft is operating, exhaust conduit means through which exhaust gasses flow form said exhaust port for delivering exhaust gases from said exhaust port to said underwater exhaust gas discharge, a catalyst bed disposed in the exhaust conduit means for treating the exhaust gases flowing there through, water pump means having an inlet in said exhaust conduit means and an outlet for conveying pumped water back to the body of water in which the watercraft is operating, and means responsive to a condition for operating said water pump means for pumping water from said exhaust conduit means and wherein the operation of said water pump means precludes water from reaching said catalyst bed.

20. A marine outboard drive comprising an internal combustion engine as set forth in claim 19, further including means for sensing the condition.

21. A marine outboard drive comprising an internal combustion engine as set forth in claim 20, wherein the sensed condition comprises a water level in the exhaust conduit means.

22. A marine outboard drive comprising an internal combustion engine as set forth in claim 21, wherein the sensing means comprises a water level sensor positioned in the exhaust conduit means.

23. A marine outboard drive comprising an internal combustion engine as set forth in claim 20, wherein the sensed condition comprises deceleration.

24. A marine outboard drive comprising an internal combustion engine as set forth in claim 23, wherein the sensed deceleration comprises watercraft deceleration.

25. Amarine outboard drive comprising an internal combustion engine as set forth in claim 24, wherein the watercraft deceleration is determined by a watercraft speed sensor.

26. A marine outboard drive comprising an internal combustion engine as set forth in claim 23, wherein the deceleration comprises deceleration of the engine.

27. A marine outboard drive comprising an internal combustion engine as set forth in claim 26, further including a throttle valve for controlling the speed of the engine and wherein the sensed deceleration is determined by rapid closure of the throttle valve.

28. A marine outboard drive comprising an internal combustion engine as set forth in claim 26, wherein the sensed deceleration of the engine is determined by an air flow sensor.

29. A marine outboard drive comprising an internal combustion engine as set forth in claim 26, wherein the sensed engine deceleration is sensed by sensing intake manifold vacuum.

30. A marine outboard drive comprising an internal combustion engine as set forth in claim 23, wherein the sensed deceleration is determined by measuring the engine speed and determining when engine speed rapidly is decreased.

31. A marine outboard drive comprising an internal combustion engine as set forth in claim 20, wherein the sensed condition is catalytic bed temperature.

32. A marine outboard drive comprising an internal combustion engine as set forth in claim 20, wherein the sensed condition is the stopping of the engine.

33. A marine outboard drive comprising an internal combustion engine as set forth in claim 20, further including means for sensing a plurality of conditions.

34. A marine outboard drive comprising an internal combustion engine as set forth in claim 33, wherein one of the conditions comprises water level in the exhaust conduit means.

35. A marine outboard drive comprising an internal combustion engine as set forth in claim 33, wherein one of the conditions sensed is engine speed deceleration.

36. A marine outboard drive comprmsing an internal combustion engine as set forth in claim 33, wherein one of the sensed conditions comprises deceleration of the associated watercraft.

37. A marine outboard drive comprising an internal combustion engine as set forth in claim 33, wherein the sensed condition is catalytic bed temperature.

38. A marine outboard drive comprising an internal combustion engine as set forth in claim 33, wherein one of the sensed conditions comprises stopping of the engine.

39. A marine outboard drive comprising an internal combustion engine as set forth in claim 20, further including means for stopping the operation of the water pump.

40. A marine outboard drive comprmsing an internal combustion engine as set forth in claim 39, wherein the stopping of the water pump means is done after a predetermined time.

41. A marine outboard drive comprmsing an internal combustion engine as set forth in claim 39, wherein the stopping of the water pump means is initiated after the sensed condition is no longer present.

42. A marine outboard drive comprising an internal combustion engine as set forth in claim 39, wherein the stopping of the water pump means is done after the temperature of the catalyst falls below a predetermined level.

43. A marine outboard drive comprising an internal combustion engine as set forth in claim 39, wherein the stopping of the water pump means is after the level of water in the exhaust conduit means falls below a predetermined water level.

44. A marine outboard drive comprising an internal combustion engine as set forth in claim 1, wherein the marine outboard drive comprises an outboard motor and the engine is positioned in a power head disposed above the drive shaft housing and lower unit.

45. A marine outboard drive comprising an internal combustion engine as set forth in claim 44, wherein the water pump means is positioned in the outboard motor.

46. A marine outboard drive comprising an internal combustion engine as set forth in claim 44, wherein the water pump means is positioned in the hull of the associated watercraft.

* * * * *